US005617771A

United States Patent [19]

Landrum

[11] Patent Number: 5,617,771

[45] Date of Patent: Apr. 8, 1997

[54] AUTO CYCLE PUMP

[75] Inventor: Michael T. Landrum, Waseca, Minn.

[73] Assignee: Power Team Div. of SPX Corp., Owatonna, Minn.

[21] Appl. No.: 585,180

[22] Filed: Jan. 11, 1996

[51] Int. Cl.[6] ..... F01B 25/06

[52] U.S. Cl. ..... 91/1; 91/59; 91/219; 91/220; 91/275; 91/281; 91/304; 91/421; 60/377; 173/2

[58] Field of Search ..... 60/377; 91/1, 59, 91/219, 220, 221, 275, 281, 304, 318, 421; 173/2, 11

[56] References Cited

U.S. PATENT DOCUMENTS

| | | | |
|---|---|---|---|
| 3,434,283 | 3/1969 | Piret | 91/275 |
| 4,002,103 | 1/1977 | Martin | 91/219 |
| 4,275,793 | 6/1981 | Schivley et al. | 91/318 |
| 4,860,646 | 8/1989 | Spiers | 60/377 |

FOREIGN PATENT DOCUMENTS

| | | | |
|---|---|---|---|
| 92/19871 | 11/1992 | WIPO | 91/1 |

*Primary Examiner*—F. Daniel Lopez
*Attorney, Agent, or Firm*—Wood, Phillips, VanSanten, Clark & Mortimer

[57] ABSTRACT

An auto cycle pump in accordance with the invention includes a housing having a reservoir for storing hydraulic fluid. A hydraulic pump in the housing provides hydraulic flow. A directional valve has neutral, advance and retract positions to respectively restrict hydraulic flow, direct hydraulic flow to an advance port and direct hydraulic flow to a retract port, the ports for hydraulic connection to the hydraulic tool, in use. Fluid conduits are provided connecting the pump and reservoir to the directional valve. A flow switch detects return flow from the directional valve to the reservoir. A pressure sensor sense hydraulic pressure from the pump. A dump valve is operatively connected to the pump for directing hydraulic flow back to the reservoir when the directional valve is in the neutral position. A control is operatively connected to the pump, the directional valve, the flow switch and the pressure sensing means for controlling operation of the auto cycle pump in automatic mode of operation. The automatic mode of operation includes activating the pump and controlling a repeatable cycle. The cycle includes operating the directional valve to the advance position or the retract position to selectively advance or retract the tool, returning the directional valve to the neutral position when the flow switch senses loss of return flow, and completing the cycle when the flow switch again senses loss of flow after flow from decompression of the fluid conduit means has stopped. The first step is configured to operate the valve alternately to the advance position and the retract position in alternate cycles, the repeatable cycle continuing until a select pressure is sensed by the pressure sensor.

15 Claims, 8 Drawing Sheets

AUTO CYCLE PUMP

FIELD OF THE INVENTION

This invention relates to the field of hydraulic tools and, more particularly, to an auto cycle pump for controlling tool operation automatically.

BACKGROUND OF THE INVENTION

A hydraulic tool in one form comprises a hydraulic torque wrench. A hydraulic torque wrench includes a ratchet mechanism with a drive including a double-acting hydraulic cylinder. The cylinder is reciprocated to operate the ratchet to provide torquing as high as thousands of foot pounds. The reciprocation of the hydraulic cylinder is typically accomplished using a hydraulic pump with flow being selectively directed to opposite sides of the cylinder.

Existing pumps for operating hydraulic torque tools can generally be categorized as manually operated, programmable automated, and automated without the use of programming.

With an entirely manually operated pump, the operator must cycle the pump through the different portions of its cycle manually. With a programmable automated system, the operator must first program the pump by entering such information as torque wrench model or size, torque to be achieved, desired pressure and dwell time at the end of operation. These pumps are not user friendly, as they can be difficult to program. The automated pumps without the programming function typically use sensors within the pump or valve to indicate when the tool has reached the end of its stroke, and then shift a valve to begin the next step of the cycle. These pumps can be unreliable because of the variable signals that can be sensed before the tool reaches the end of its stroke. The variable signals can be due to hose decompression, tool backlash, the size of the tool and the length of the hoses used in the system.

The present invention is directed to solving one or more of the problems discussed above in a novel and simple manner.

SUMMARY OF THE INVENTION

In accordance with the invention there is disclosed an auto cycle pump for controlling operation of a hydraulic tool.

Broadly, the auto cycle pump in accordance with the invention includes a housing having a reservoir for storing hydraulic fluid. A hydraulic pump in the housing provides hydraulic flow. A directional valve has neutral, advance and retract positions to respectively restrict hydraulic flow, direct hydraulic flow to an advance port and direct hydraulic flow to a retract port, the ports for hydraulic connection to the hydraulic tool, in use. Fluid conduit means are provided connecting the pump and reservoir to the directional valve. A flow switch detects return flow from the directional valve to the reservoir. Pressure sensing means sense hydraulic pressure from the pump. A dump valve is operatively connected to the pump for directing hydraulic flow back to the reservoir when the directional valve is in the neutral position. A control means is operatively connected to the pump, the directional valve, the flow switch and the pressure sensing means for controlling operation of the auto cycle pump in automatic mode of operation. The automatic mode of operation includes activating the pump and controlling a repeatable cycle. The cycle includes operating the directional valve to the advance position or the retract position to selectively advance or retract the tool, returning the directional valve to the neutral position when the flow switch senses loss of return flow, and completing the cycle when the flow switch again senses loss of flow after flow from decompression of the fluid conduit means has stopped. The first step is configured to operate the valve alternately to the advance position and the retract position in alternate cycles, the repeatable cycle continuing until a select pressure is sensed by the pressure sensing means.

In accordance with one aspect of the invention, the directional valve comprises a pilot operated directional valve.

In accordance with another aspect of the invention, the pump comprises a two stage pump operated by an electric motor.

In accordance with a further aspect of the invention, a user-actuated control is connected to the control means for initiating operation of the automatic mode of operation.

In accordance with a further aspect of the invention, the control means includes a programmable control device operating in accordance with a stored program. The programmable control device stores a cycle time representing duration of each cycle, the cycle time being used in a subsequent cycle to anticipate cycle time. A portion of the cycle time is used to ignore the flow switch to prevent premature cycle completion. More particularly, the programmable control device stores a cycle time representing duration of each advance cycle and each retract cycle, the cycle time being used in each subsequent respective advance cycle or retract cycle to anticipate cycle time.

In accordance with an alternative aspect of the invention, the auto cycle pump comprises a housing including a reservoir for storing hydraulic fluid. A hydraulic pump in the housing provides hydraulic flow. An electric motor drives the hydraulic pump. A directional valve has neutral, advance and retract positions to respectively restrict hydraulic flow, direct hydraulic flow to an advance port and direct hydraulic flow to a retract port, the ports for hydraulic connection to the hydraulic tool, in use. Fluid conduit means connect the pump and reservoir to the directional valve. A flow switch detects return flow from the directional valve to the reservoir. Pressure sensing means sense hydraulic pressure from the pump. A dump valve is operatively connected to the pump for directing hydraulic flow back to the reservoir when the directional valve is in the neutral position. A programmable logic control means is operatively connected to the motor, the directional valve, the flow switch and the pressure sensing means for controlling operation of the auto cycle pump in an automatic mode of operation in accordance with a stored program. The automatic mode of operation includes energizing the motor and controlling a repeatable cycle. The cycle includes operating the directional valve to either the advance position or the retract position to selectively advance or retract the tool, returning the directional valve to the neutral position when the flow switch senses loss of return flow, and completing the cycle when the flow switch again senses loss of flow after flow from decompression of the fluid conduit means has stopped. The initial step is configured to operate the valve alternately to the advance position and the retract position in alternate cycles. The repeatable cycle continues until a select pressure is sensed by the pressure sensor.

Thus, in accordance with the invention, the auto cycle pump automatically advances and retracts a tool through its cycle both in the no-load and loaded conditions. The pump shuts off when the tool has met a pre-set pressure. The pump automatically changes modes when the pressure is met so the operator can manually finish the torque operation. The pump allows the operator to select whether to operate the pump manually or automatically. The pump automatically adjusts for and operates with different size tools and different size hoses with no set-up. Torque pressure and safety pressures are achieved with only a single setting. The pump ignores false signals due to hose decompression and due to tool backlash. These features are accomplished with use of no sensors at the tool. Finally, the auto cycle pump provides self-taught compensation for duty cycle duration changes.

More particularly, by utilizing a dump valve in connection with a directional valve and a flow sensor, the system is capable of sensing extremely low flow rates and operating and monitoring the sequence with a programmable logic controller programmed to store, and use, learned dam. The design is capable of performing in an automatic mode without the use of any sensor at the tool. Because of the pump's unique design and the self-learning property of the logic program, it is possible to have automatic operation without the necessity of special set-up when different sizes of tools are used and when hose length and size are changed.

Further features and advantages of the invention will be readily apparent from the specification and the drawing.

DETAILED DESCRIPTION OF THE INVENTION

Figure 2:
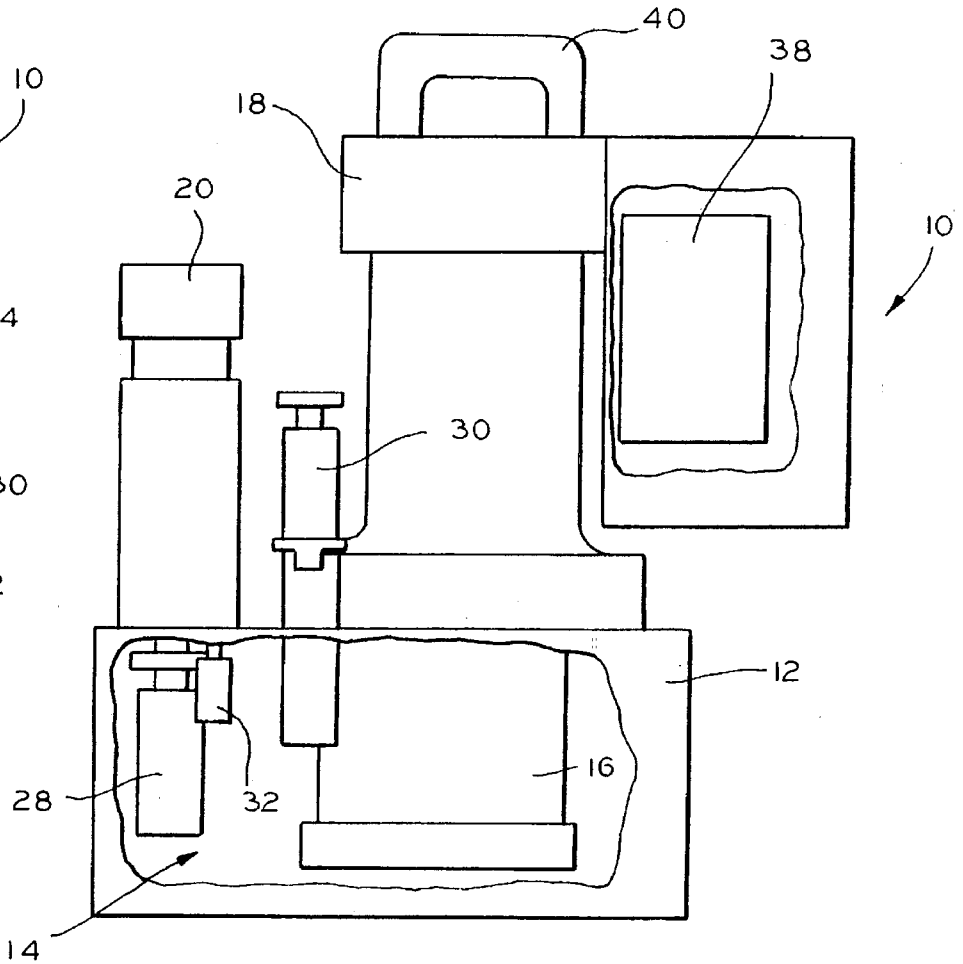
FIG. 2 is a side elevation view of the pump of FIG. 1 with parts removed for clarity.
Figure 1:
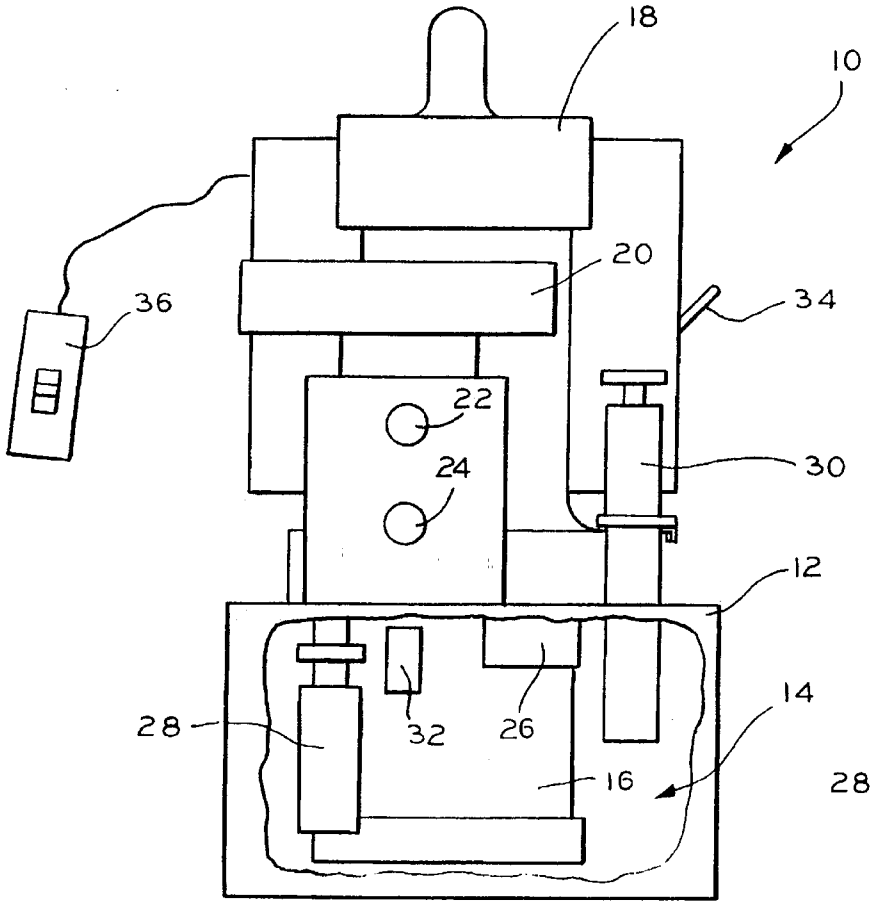
FIG. 1 is a front elevation view of an auto-cycle pump according to the invention, with portions removed for clarity.

Referring initially to FIGS. 1 and 2, an auto cycle pump 10 according to the invention is illustrated. The auto cycle pump 10 is operable to control operation of a hydraulic tool that is cyclically and alternately advanced and retracted to operate the tool.

The pump 10 includes a base in the form of a housing 12 including an internal reservoir 14 for storing hydraulic fluid. A hydraulic pump 16 is integrally mounted to the housing 12 and extends downwardly into the reservoir 14. The hydraulic pump provides hydraulic flow. The pump 16 is driven by an electric motor 18. A hydraulic directional valve 20 directs hydraulic flow, as described below, from the pump 16 to an advance port 22 or a retract port 24, the ports 22 and 24 for hydraulic connection to the hydraulic tool, in use.

A hydraulic dump valve 26 directs hydraulic flow back to the reservoir 14 between advance and retract cycles. A hydraulic flow switch 28 detects return flow from the directional valve 20. A combined pressure regulator and pressure switch 30 detects when a preset pressure is met, and limits maximum hydraulic pressure that can be achieved. A hydraulic pressure relief valve 32 limits the maximum hydraulic pressure that can be achieved on the retract stroke of the tool. A selector switch 34 determines whether the pump is in a manual mode, a torque mode or a loosen mode. A hand-held pendant switch 36 enables the operator to initiate operation of the pump or to stop operation of the pump. The pendant 36 is also used when the pump 10 is set in the manual mode, as described below. The control of the pump 10 is accomplished using a conventional programmable logic controller (PLC) 38 electrically connected to the various electrical devices, as described below. As is conventional, the PLC 38 includes a processing unit and associated memory. The processing unit operates in accordance with a control program stored in the memory. The particular form of the PLC is not critical to the claimed invention and may comprise any conventional PLC or personal computer or the like programmed to operate as generally described herein.

All of the components described relative to FIGS. 1 and 2 are contained in a unitary structure. The housing 12 serves as a base for the various other components which are mounted thereto. A carrying handle 40 enables the pump 10 to be lifted and carried about as necessary. The pump 10 thus comprises a self-contained unit which performs in an automatic mode without use of any sensors at the tool. Instead, the only connections to the tool are a pair of hoses connected to the ports 22 and 24, as described below.

Figure 3:
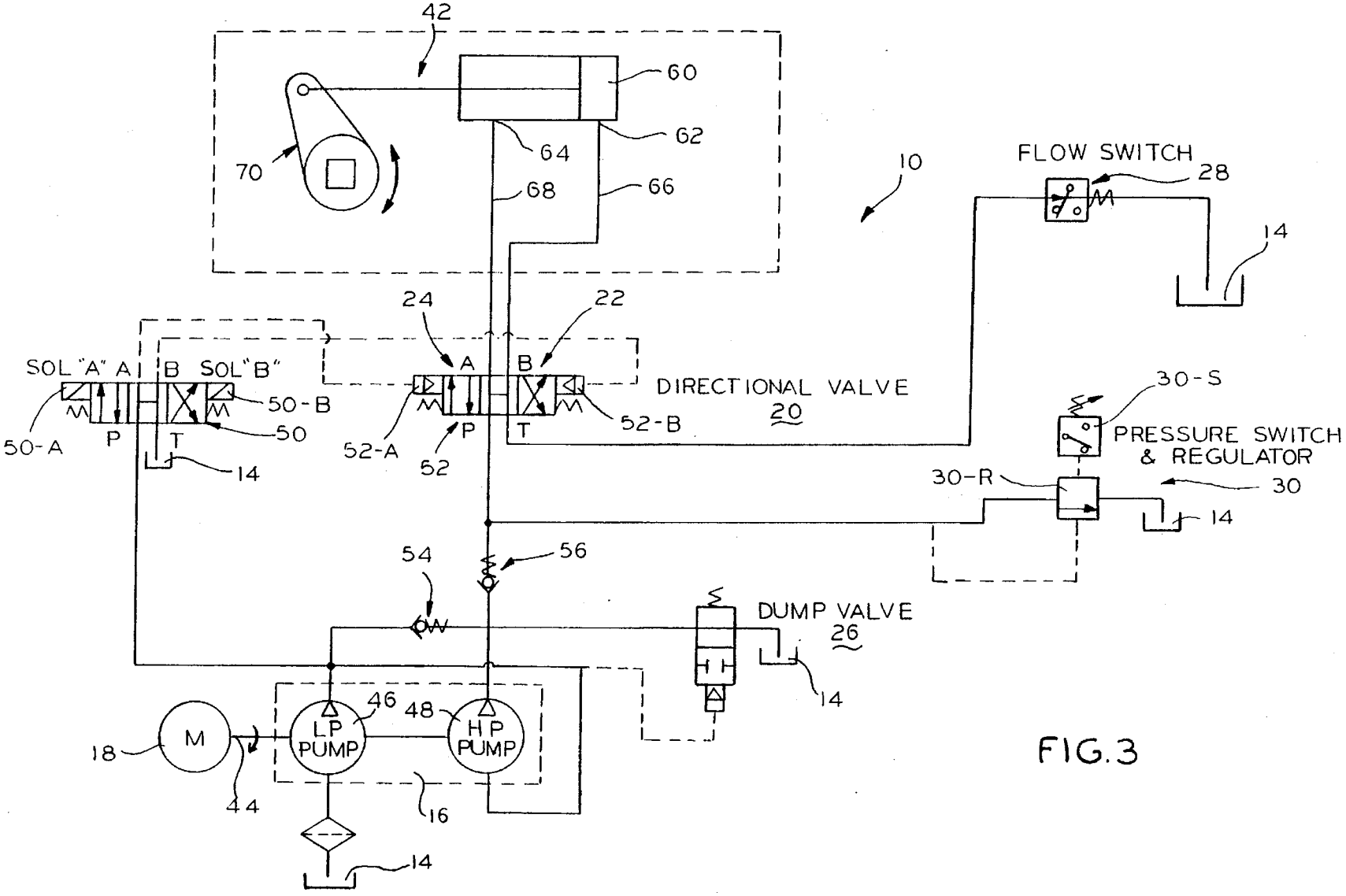
FIG. 3 is a hydraulic schematic of the pump of FIG. 1 when connected to a hydraulic tool.

With reference to FIG. 3, a hydraulic schematic illustrates internal connections of the components of the auto cycle pump 10, as well as connection to a hydraulic torquing tool 42.

The motor 18 includes an output drive shaft 44 for driving the pump 16. The pump 16 comprises a two-stage pump, including a low pressure pump 46 and high pressure pump 48. The directional valve 20 comprises a pilot operated directional valve including a pilot valve 50 and an output valve 52. Each of the valves 50 and 52 are similarly configured and include central neutral positions and opposite advance and retract positions to respectively restrict hydraulic flow, direct hydraulic flow to an advance port, and direct hydraulic flow to a retract port. The pilot valve 50 includes electrical solenoids 50-A and 50-B for controlling positioning. The output valve 52 is hydraulically driven by the pilot valve 50. Each of the valves 50 and 52 includes a pressure port P, a tank port T and output ports A and B. On the output valve 52, the output ports A and B comprise the retract and advance ports 24 and 22, respectively, see FIG. 1.

The auto cycle pump 10 includes various internal hoses or conduits for conveying hydraulic flow from one device to another, as illustrated. Particularly, the low pressure pump 46 receives hydraulic fluid from the tank, or reservoir, 14 which supplies the high pressure pump 48. Also, the low pressure pump 46 is connected to the pressure port of the pilot valve 50 and to the hydraulic solenoid of the dump valve 26. The low pressure pump 46 is also connected through a check valve 54 to the input side of the dump valve 26. The dump valve 26 is configured to be normally open with its output side connected to the reservoir 14.

The output of the high pressure pump 48 is connected through a check valve 56 to the pressure port of the output valve 52. The tank port of the output valve 52 is connected through the flow switch 28 to the reservoir 14. The output of the high pressure pump 48, opposite the check valve 56, is also connected via the combined pressure switch and regulator 30 to the reservoir 14. As shown, the combined pressure switch and regulator 30 include a pressure switch 30-S and a pressure regulator 30-R. While these components are illustrated as unitary devices, the pump 10 could use separate pressure switches and regulators, as is apparent.

The tank port of the pilot valve 50 is connected to the reservoir 14. The output port A is connected to a first hydraulic solenoid 52-A of the output valve 52, while the output port B is connected to a second hydraulic solenoid 52-B of the output valve 52.

The hydraulic tool 42 includes a hydraulic cylinder 60 having an advance port 62 and a retract port 64. The ports 62 and 64 are connected, in use, via respective hoses 66 and 68 to the advance and retract ports 22 and 24 of the output valve 52. The cylinder 60 drives a ratchet mechanism 70 associated with the tool. The ratchet drives an appropriate wrench or other mechanism as is necessary or desired. The cylinder 60 comprises a double-acting cylinder which is reciprocated to run the ratchet mechanism 70, as is well known. The particular structure of the tool 42 does not form part of the invention. Instead the invention relates to a pump capable of controlling operation of a reciprocating tool, such as a hydraulic torque wrench.

Figure 4:
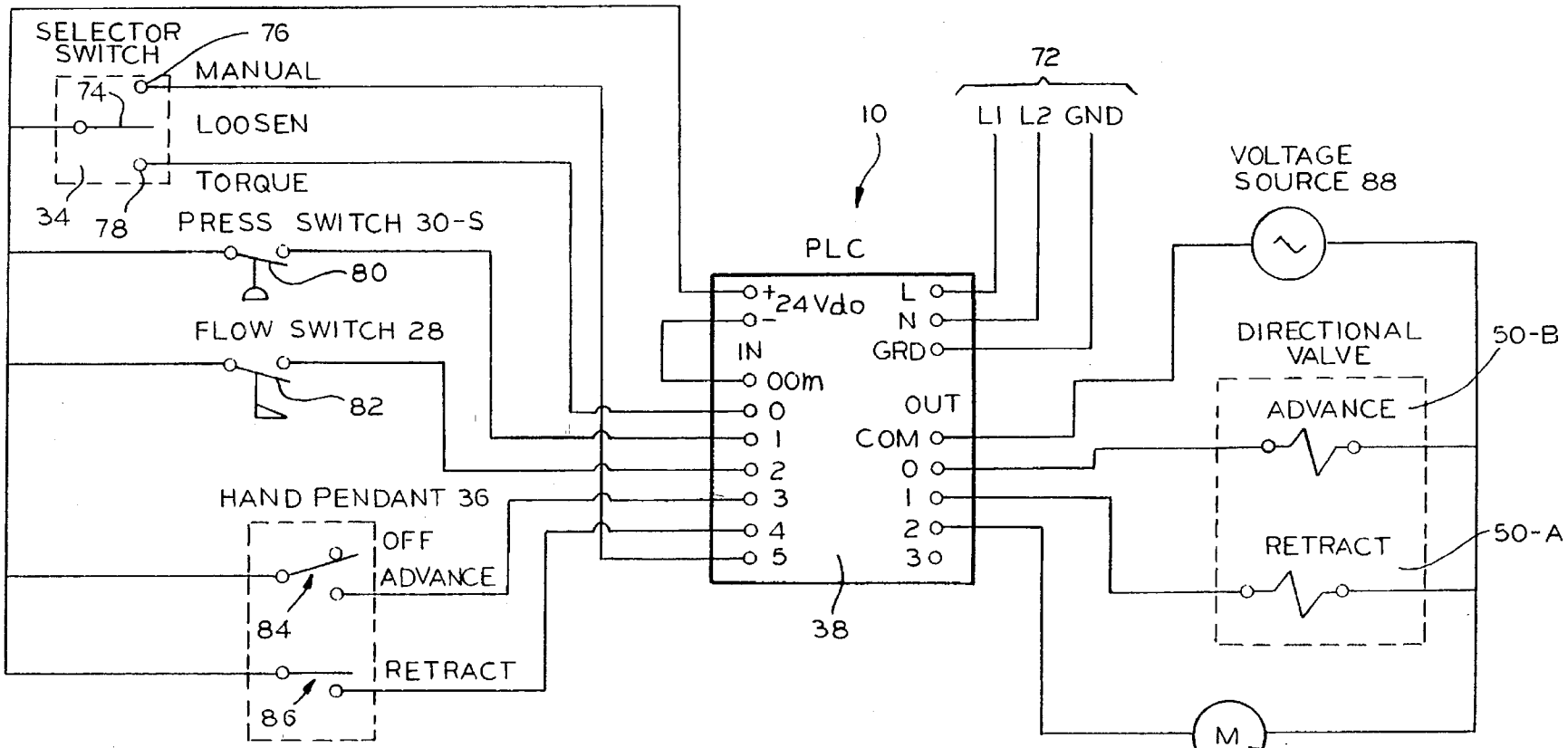
FIG. 4 is an electrical schematic for the pump of FIG. 1.

Referring to FIG. 4, an electrical schematic illustrates internal electrical connections of the auto cycle pump 10.

The PLC 38 receives power from a conventional AC power source 72. The PLC 38 includes plural input ports for receiving status signals and output ports for driving output devices.

The selector switch 34 includes a movable contact 74 and fixed contacts 76 and 78. The selector switch 34 has three positions. The central, or neutral, position comprises the loosen mode, with the movable contacts 74 spaced from both fixed contacts 76 and 78. The manual mode is used when the movable contact 74 contacts the first fixed contact 76. The torque mode is used when the movable contact 74 contacts the second fixed contact 78. The fixed contacts 76 and 78 are connected to input ports 5 and 0, respectively. The pressure switch 30-S includes an electrical switch 80 connected to input port 1. The flow switch 28 includes an electrical switch 82 connected to the input port 2. The hand pendant 36 includes two switches 84 and 86. The first switch 84 is closed in an advance position and open in an off position. The second switch 86 is closed in a retract position. The switches 84 and 86 are connected to the third and fourth inputs of the PLC 38, respectively.

On the output side of the PLC 38, a common is connected to one side of a voltage source 88, the opposite of which provides power to the output devices. Output port 0 is connected to the advance solenoid 50-B. Output port 1 is connected to a retract solenoid 50-A. Output port 2 is connected to the electric motor 18.

As discussed generally above, the PLC 38 operates in connection with a stored program for controlling the output devices based on signals received from the input devices. The flow diagram of FIGS. 5A–5E describe the sequence of operation. Particularly, the flow diagram illustrates the overall sequence of operation for the hydraulic system of FIG. 3 in accordance with the program implemented by the PLC 38. For simplicity, reference to devices in the flow chart is as follows: the directional valve 20 is referred to as "valve"; the dump valve 26 is referred to as "dump"; the flow switch 28 is referred to as "flow-SW"; the pressure regulator 30-R is referred to as "reg"; the pressure switch 30-S is referred to as "pressure"; the pendant 36 is referred to as "pen". The indicators Y and N are used to represent yes and no conditions, the letters A, N and R is advance, neutral and retract, F and No F for flow and no flow, and on and off for the same. Other variables will be described as they are referred to hereinbelow. A diamond symbol is used for devices for which three conditions exist, while a rectangle is used for operations for which two conditions exist.

Figure 5A:
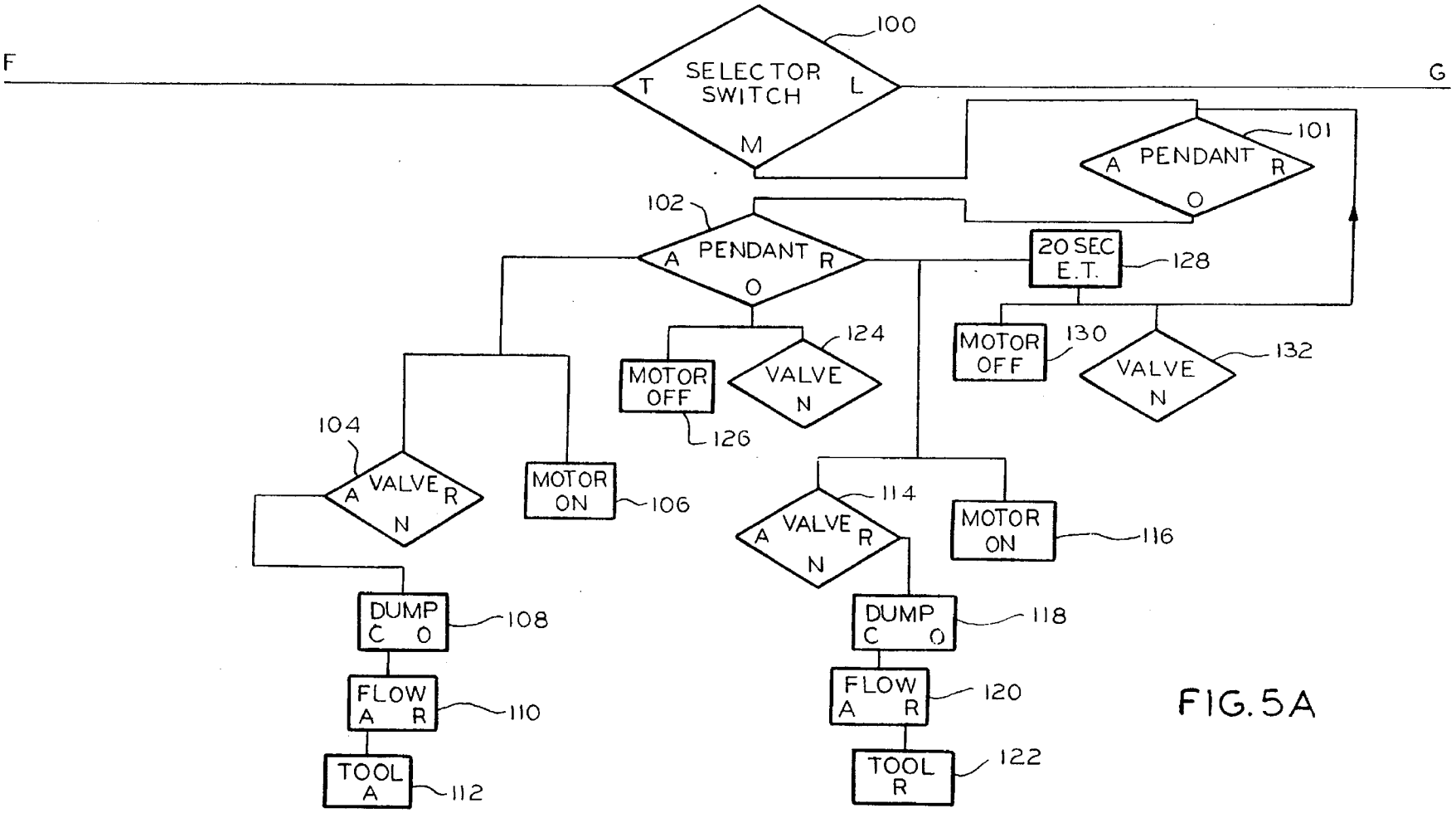
FIGS. 5A–5E comprise a series of flow charts illustrating operation of the pump in the schematic of FIG. 3.

Referring initially to FIG. 5A, the flow diagram begins at a block 100 which determines whether the selector switch 34 is in the torque, manual or loosen position. If manual, then the tool 42 is operated in accordance with a manual mode.

In the manual mode, the pendant switch 36 must first be in the off position at block 101. If not, then the program will not proceed. This is used for safety reasons. The operator then depresses and holds the pendant switch 36 in the advance position at a block 102. This signal is received by the PLC 38, which sends a signal to the directional valve 20 to shift to the advance position, see block 104, and also sends a signal to start the pump motor 18 at block 106. This applies a pilot signal to the dump valve 26 at block 108 which doses the dump valve. Hydraulic flow is now directed to the advance port of the tool at a block 110 which begins to advance at a block 112.

Returning to the block 102, the after determining that the tool has fully advanced the operator releases the pendant switch 36 to the retract position. The signal is received by the PLC 38 which sends a signal to the directional valve 20 at a block 114 to shift the retract position and the motor is turned on at a block 116. This applies a pilot signal to the dump valve which closes at a block 118. The dump valve 26 remains closed and hydraulic fluid is directed to the retract port at a block 120 and the tool will begin to retract at a block 122.

The above described sequence of advancing and retracting is repeated by the operator until the torquing application is finished. When the torquing application is finished, the operator depresses the hand pendant switch to the off position at the block 102. The directional valve 20 is then returned to the center or neutral position at a block 124 and the motor 18 is turned off at a block 126. The system is therefore shut off. Alternatively, if the operator leaves the hand pendant 36 in the retract position for more than twenty seconds, at the block 128, then the PLC 38 senses this and automatically shuts the system off by turning the motor off at a block 130 and moving the directional valve 20 the neutral position at a block 132.

Figure 5B:
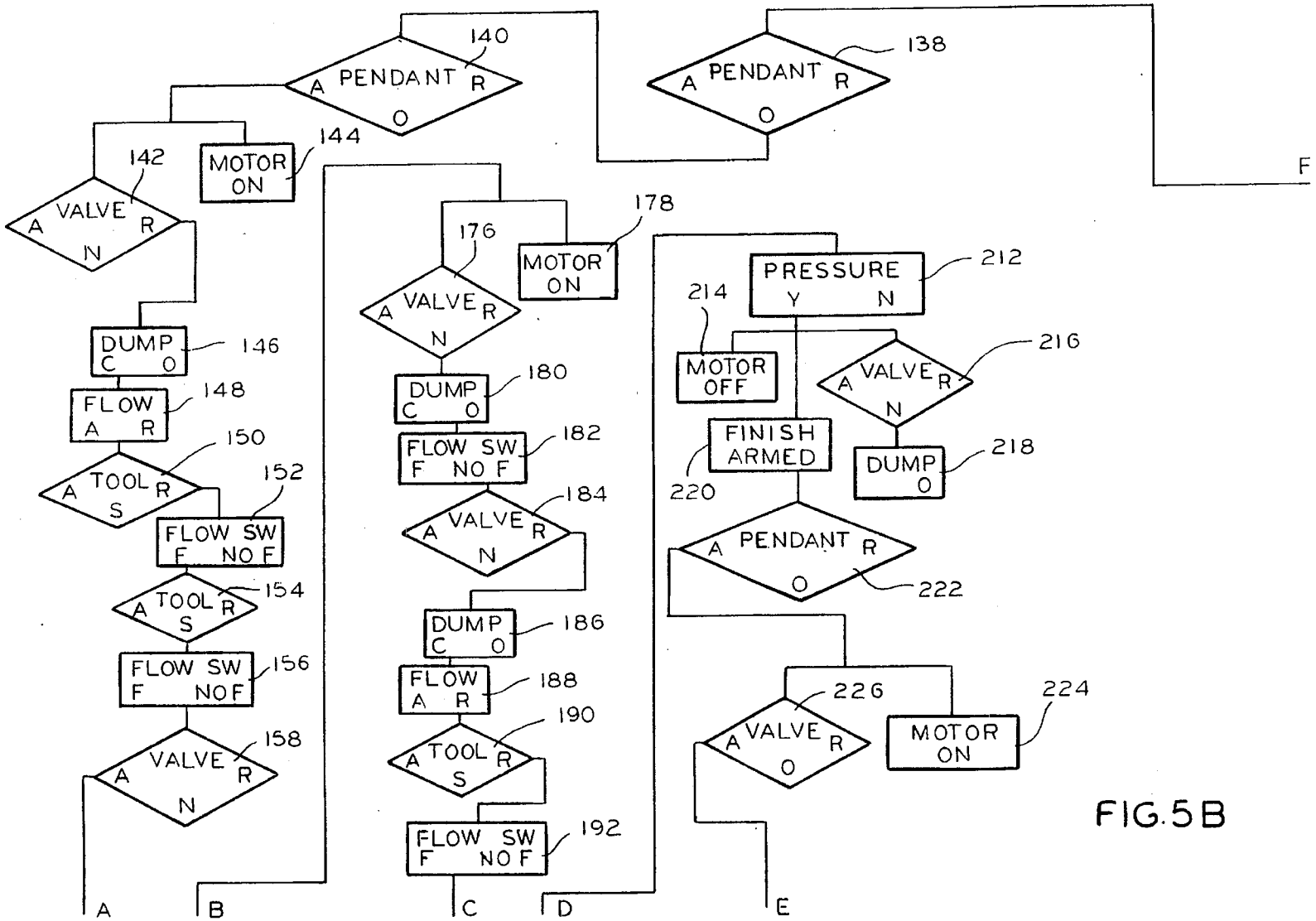
Figure 5C:
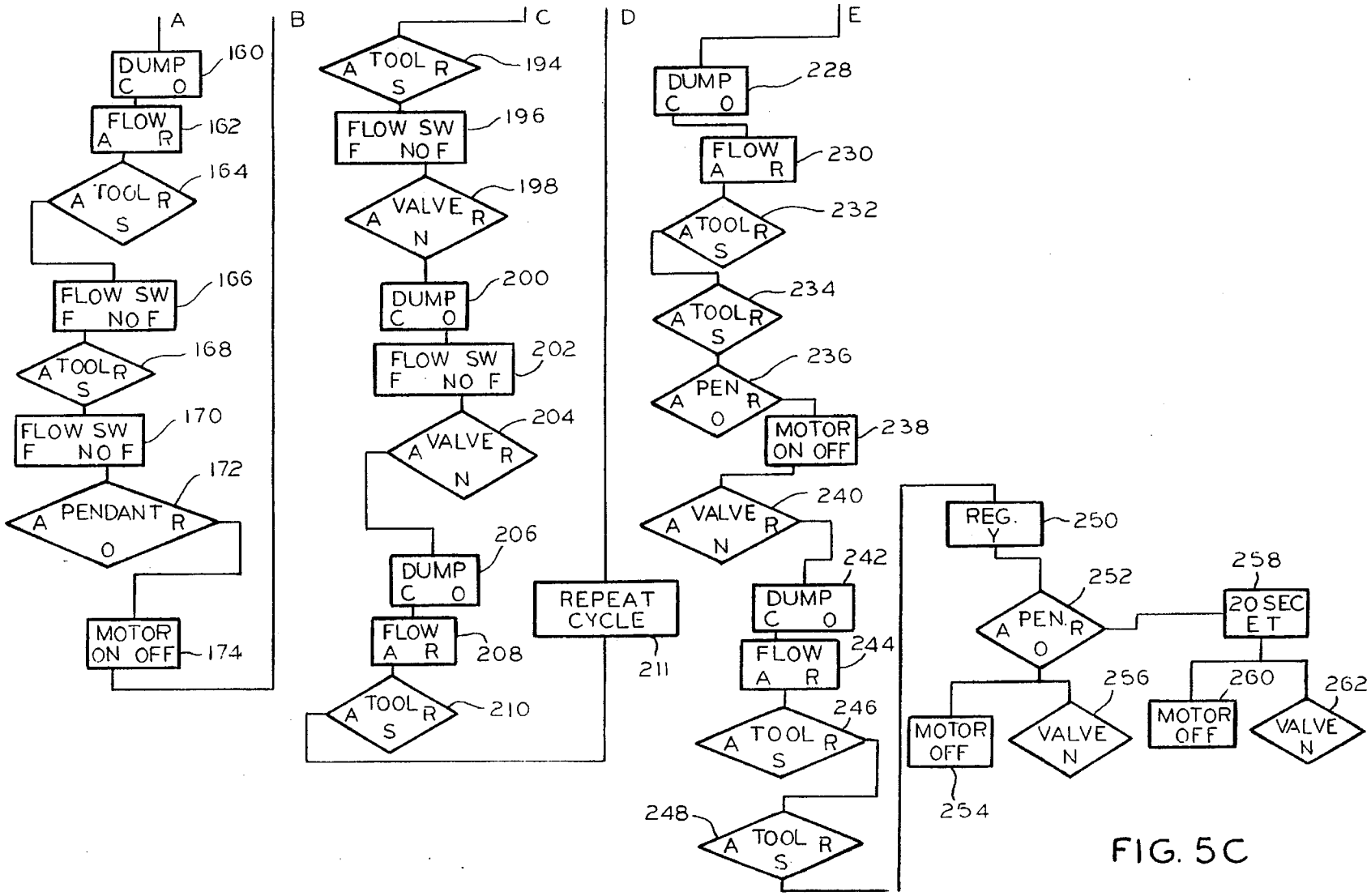
Figure 5D:
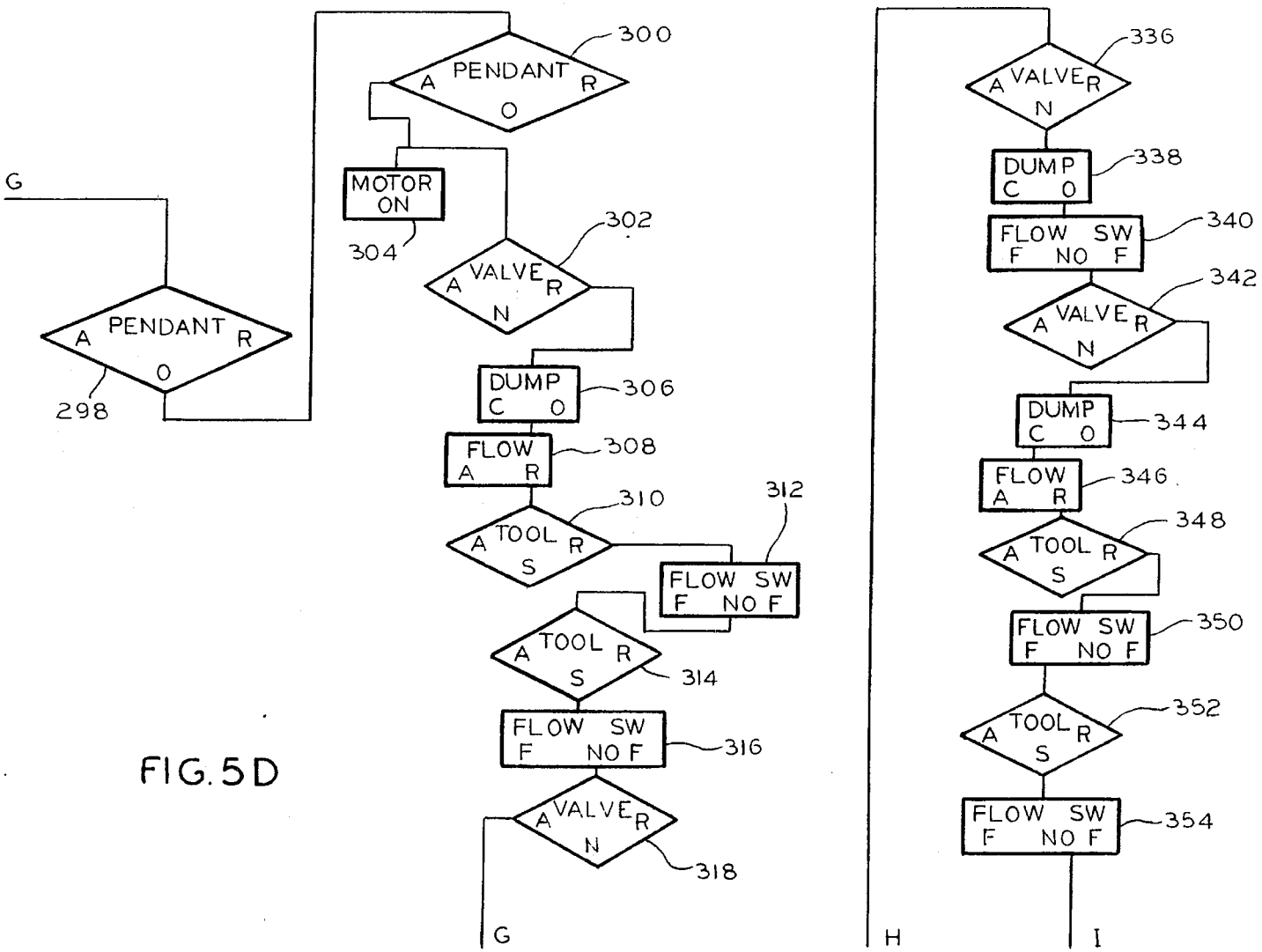
Figure 5E:
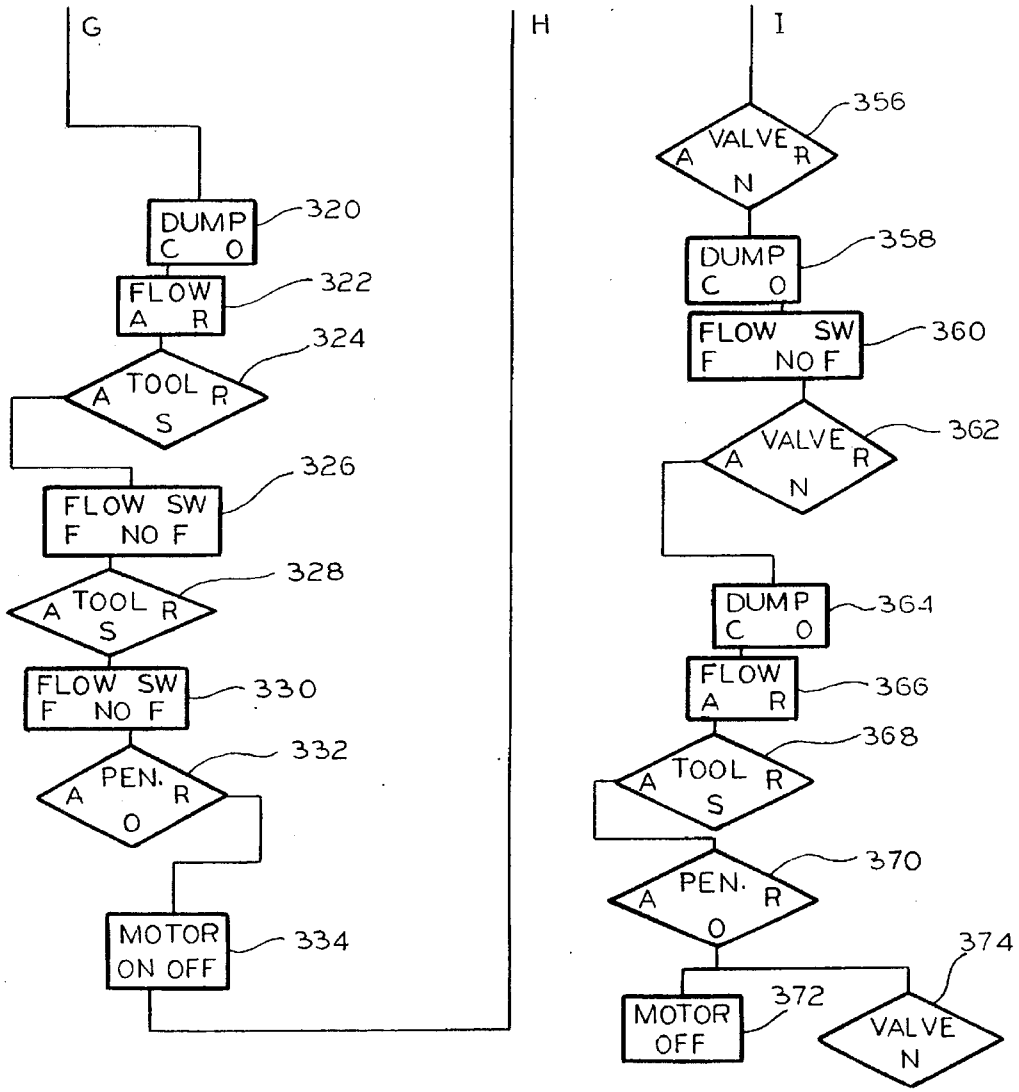

The invention is particularly directed to the use of the torque and loosen modes in the auto cycle pump 10. If the operator puts the selector switch 34 in the torque position, then this signal is received by the PLC 38 at the block 100, which sets the logic program for the torque mode. The torque mode is illustrated in FIGS. 5B and 5C. The pendant switch 36 must first be in the off position at block 138. Then, at a block 140, the operator depresses and holds the pendant switch 36 in the advance position. Upon receiving this signal, the PLC 38 automatically operates the system in the torque mode. The PLC 38 sends a signal to the directional valve 20 to shift to the retract port at a block 142 and turns the motor on at a block 144. This applies a pilot signal to the dump valve 26, which closes at block 146. Hydraulic flow is now directed to the retract port 24 at a block 148 and the tool begins to retract at a block 150. The flow switch 28 senses flow at the block 152. When the tool 42 has fully retracted, then it stops at a block 154. The return flow from the tool will stop. The loss of flow is sensed by the flow switch 28 at the block 156 and the flow switch 28 sends a signal to the PLC 38. The PLC 38 verifies that it is a good signal based on the time duration of the signal being sufficiently long to indicate a static condition. At this time the tool is in the fully retracted position for starting.

The PLC 38 then sends a signal to the directional valve 20 to shift to the advance position at a block 158. The dump valve 26 remains closed at the block 160 and hydraulic flow is now directed out the advance port 22 at block 162. The tool begins to advance at a block 164. Hydraulic flow continues and is sensed by the flow switch 28 at block 166. Once the tool is fully advanced, the tool stops at block 168 and the return flow from the tool will stop. This loss of flow is sensed by the flow switch at block 170. The PLC 38 then stores a portion of the advance cycle time value in data memory for use in the next advance cycle. This information is learned for every advance cycle for use in the subsequent advance cycle. At this time, the operator releases the pendant switch 36 from the advance position which sends a signal to the PLC 38. The operator knows when to release the pendant switch 36 by observing the tool movement and the pump pressure. The motor 18 remains on at block 174. The PLC 38 then removes the signals to the directional valve 20, which shifts to the neutral position at block 176. The motor remains on at the block 78. As a result, the pilot signal is removed from the dump valve 26, which opens at block 180. The dump valve opening allows pump flow to be directed back to the reservoir 14 through the dump valve 26. At this time, flow will resume through the hydraulic hoses due to decompression. When all of the flow from the decompression of the hydraulic hoses has stopped, the flow loss is sensed by the flow switch 28 at block 182. This completes the cycle. Control then proceeds to another cycle. As described, the system alternates between an advance cycle and a retract cycle, each cycle being generally similar to that discussed above.

Particularly, the PLC 38 sends a signal to the directional valve 20 to shift to the retract position at block 184. This applies a pilot signal to the dump valve 26 which closes at block 186. Hydraulic flow is directed to the retract port 24 at block 188 and the tool retracts at block 190. Hydraulic flow is sensed by the flow switch 28 at block 192. When the tool is fully retracted, it stops at a block 194. The loss of flow is detected by the low switch 28 at block 196. The PLC 38 now stores a portion of the retract cycle time value in data memory for use in the next retract cycle. This information is learned for every retract cycle, as with the advance cycle discussed above.

The PLC 38 removes the signals to the directional valve 20 so that it returns to the neutral position at block 198 and the pilot signal is removed from the dump valve which opens at block 200. This allows pump flow to be directed back to the reservoir 14 through the dump valve 26. When all of the flow from the decompression of the hydraulic hoses has stopped, the flow loss is sensed by the flow switch 28 at block 202 to complete the retract cycle.

The advance cycle is then repeated beginning at blocks 204, 206, 208 and 210. This advance, dump, retract and dump sequence continues automatically as the torquing application progresses, as represented by block 211, until a preset pressure set at the combined pressure switch and regulator 30 is met. Particularly, as the tool is advancing and the pressure builds to its preset level, the pressure is sensed by the pressure switch 30-S, which sends a signal to the PLC 38 at block 212. The PLC 38 turns the motor 18 off at block 214 and removes the signal from the directional valve 20 at block 216 so that it returns to the neutral position. This opens the dump valve at block 218.

The PLC 38 then sets the logic for a finish mode which allows the operator to finish the torquing of the hydraulic tool 42, beginning at a block 220.

The operator depresses the pendant switch 36 in the advance position at block 222. The PLC 38 turns the motor 18 on at block 224 and shifts the directional valve 20 to the advance position at block 226. A pilot signal is applied to the dump valve 26 which closes at block 228 and hydraulic flow is directed to the advance port 22 at block 230 and the tool advances at block 232. Movement continues until the tool reaches the fully advanced position so that it stops at the block 234. The operator releases the pendant switch 36 to the retract position at block 236. The motor remains on at block 238. The directional valve 20 is shifted to the retract position at block 240 and the dump valve remains closed at block 242. Hydraulic flow is directed to the retract port 24 at block 244 and the tool begins to retract at block 246. The tool stops once it reaches the retract position at block 248.

This advance and retract sequence is repeated by the operator until the tool will no longer advance and the preset pressure is maintained. At this point hydraulic fluid is directed through the pressure regulator 30-R at block 250, which regulates hydraulic pressure. The operator then depresses the pendant switch 36 to the off position at block 252 the motor is turned off at block 254 and the directional valve is returned to the neutral position at block 256. If the operator leaves the hand pendant 36 in the retract position for more than twenty seconds, at the block 258, then the motor is also turned off at a block 260 and the directional valve 20 is returned to the neutral position at a block 262. At this point the pendant switch 36 must be placed in the off position in order to reset the logic program.

Returning to FIG. 5A, the operator can also select a loosen mode at the block 100. The loosen mode is illustrated in the flow diagrams of FIGS. 5D and 5E.

The pendant switch 36 must first be in the off position at a block 298. The operator initiates the loosen mode by holding the pendant switch 36 in the advance position at block 300. The PLC 38 then automatically operates the system in the loosen mode. The PLC 38 sends a signal to the directional valve 20 to shift to the retract port at block 302 and turns the motor 18 on at block 304. This applies a pilot signal to the dump valve 26, which closes at block 306, and hydraulic flow is directed to the retract port 24 at block 308. The tool begins to retract at block 310 so that the flow switch 28 senses flow at block 312. Once the tool reaches the retracted position, then it stops at a block 314. The return flow from the tool stops. This loss of flow is sensed by the flow switch 28 at block 316.

The first advance cycle begins at block 318 by the PLC shifting the directional valve 20 to the advance position. The dump valve 26 remains closed at block 320. Flow is directed to the advance port 22 at block 322 and the tool begins to advance at block 324. Hydraulic flow is sensed by the flow switch 28 at block 326. This continues until the tool reaches the advance position and stops at block 328 and return flow from the tool stops. This loss of flow is sensed by the flow switch 28 at block 330. The PLC 38 now stores a portion of the advance cycle time value in data memory for use in the next advance cycle. The operator then releases the pendant switch 36 to the retract position at block 332. The operator knows when to release the pendant switch 36 by observing the tool movement and the pump pressure. The motor 18 remains on at block 334. The PLC 38 completes the advance cycle by removing the signal from the directional valve 20 at block 336 so that it returns to the neutral position. The pilot signal is removed from the dump valve 26 which opens, allowing pump flow to be directed back to the reservoir 14 at block 338. When all of the flow from decompression of the hydraulic hoses has stopped, the flow loss is sensed by the flow switch 28 at block 340.

The PLC 38 then begins the retract cycle by shifting the directional valve 20 to the retract position at block 342. The dump valve 26 closes at block 344. Flow is directed to the retract port 24 at block 346. The tool begins to retract at block 348 and hydraulic flow is sensed by the flow switch 28 at block 350. When the tool is fully retracted, the return flow from the tool stops. This loss of flow is sensed by the flow switch 28 at block 354. The PLC 38 stores a portion of the retract cycle time value in data memory for use in the next retract cycle. The PLC 38 removes the signal from the directional valve 20 so that it returns to the neutral position at block 356. The pilot signal is removed from the dump valve, which opens at block 358. This allows pump flow to be directed back to the reservoir 14. When all of the flow from the decompression of the hydraulic hoses has stopped, the flow loss is sensed by the flow switch 28 at block 360. This completes the retract cycle.

The PLC 38 then begins an advance cycle at blocks 362, 364, 366 and 368 The advance cycle continues as discussed above. Likewise, the advance, dump, retract and dump sequence continues automatically as the loosening application progresses until a stall condition is met or the operator shuts off the pump by depressing the off position on the hand pendant at block 370. The motor is then turned off at block 372 and the directional valve 20 shifts into the neutral position at block 374. A stall condition is sensed when the nut or bolt being loosened breaks away too quickly for the previously learned time cycle to recognize. If this happens, the system automatically shuts down. To reinitiate operation the operator depresses the hand pendant to the off position and restarts the system in the usual manner.

In accordance with the invention, the auto cycle pump is operable to control operation of virtually any hydraulic torquing tool or reciprocating tool which operates in a manner generally similar to that described herein. The automatic control is accomplished without use of position sensors or the like located at the tool. By utilizing a dump valve in connection with a directional valve and a flow sensor capable of sensing extremely low flow rates and operating and monitoring this sequence, with a controller programmed to store, and use, learned dam, the pump is capable of performing in an automatic mode without the use of any sensors at the tool.

In accordance with the invention, a portion of the cycle time for each advance and retract cycle is monitored and stored as a time value. In the subsequent advance or retract cycle, the stored time for the previous respective advance or retract cycle is used. Particularly, this signal is used so that the input signals are ignored until a certain percentage of time has passed. This enables a system to ignore flow signal chatter. In one embodiment of the invention, the signals are ignored for at least fifty percent (50%) of the time of the previous cycle. This prevents premature completion of each cycle due to inadvertent sensing based on flow signal chatter.

Thus, in accordance with the invention, an auto cycle pump is illustrated which is easy to use and requires no position detection at the tool, no electrical cables but only two hydraulic hoses between the tool and pump, and no operator interface. The operator need not input information on hose length, tool type, torque level or the like. The only input to be entered by the operator is setting the preset pressure on the combined pressure switch and regulator 30.

I claim:

1. An auto cycle pump for controlling operation of a hydraulic tool that is cyclically and alternately advanced and retracted to operate the tool, the auto cycle pump controlling the tool operation automatically and comprising:

a housing including a reservoir for storing hydraulic fluid;

a hydraulic pump in the housing providing hydraulic flow;

a directional valve having neutral, advance and retract positions to respectively restrict hydraulic flow, direct hydraulic flow to an advance port and direct hydraulic flow to a retract port, the ports for hydraulic connection to the hydraulic tool, in use;

fluid conduit means connecting the pump and reservoir to the directional valve;

a flow switch for detecting return flow from the directional valve to the reservoir;

pressure sensing means for sensing hydraulic pressure from the pump;

a dump valve operatively connected to the pump for directing hydraulic flow back to the reservoir when the directional valve is in the neutral position; and control means operatively connected to said pump, said directional valve, said flow switch and said pressure sensing means for controlling operation of the auto cycle pump in an automatic mode of operation, the automatic mode of operation including activating the pump and controlling a repeatable cycle, the cycle including a) operating the directional valve to the advance position or the retract to selectively advance or retract the tool, b) returning the directional valve to the neutral position when the flow switch senses loss of return flow, c) completing the cycle when the flow switch again senses loss of flow after flow from decompression of the fluid conduit means has stopped, step a) being configured to operate the valve alternately to the advance position and the retract position in alternate cycles, the repeatable cycle continuing until a select pressure is sensed by the pressure sensing means.

2. The auto cycle pump of claim 1 wherein said directional valve comprises a pilot operated directional valve.

3. The auto cycle pump of claim 1 wherein said pump comprises a two stage pump operated by an electric motor.

4. The auto cycle pump of claim 1 further comprising a user actuated control connected to said control means for initiating operation of the automatic mode of operation.

5. The auto cycle pump of claim 1 wherein said control means comprises a programmable control device operating in accordance with a stored program.

6. The auto cycle pump of claim 5 wherein said programmable control device stores a cycle time representing duration of each cycle the cycle time being used in a subsequent cycle to anticipate cycle time.

7. The auto cycle pump of claim 6 wherein a portion of the cycle time is used to ignore the flow switch to prevent premature cycle completion.

8. The auto cycle pump of claim 5 wherein said programmable control device stores a cycle time representing duration of each advance cycle and each retract cycle the cycle time being used in each subsequent respective advance cycle or retract cycle to anticipate cycle time.

9. An auto cycle pump for controlling operation of a hydraulic tool that is cyclically and alternately advanced and retracted to operate the tool, the auto cycle pump controlling the tool operation automatically and comprising:

a housing including a reservoir for storing hydraulic fluid;

a hydraulic pump in the housing providing hydraulic flow;

an electric motor for driving the hydraulic pump;

a directional valve having neutral, advance and retract positions to respectively restrict hydraulic flow, direct hydraulic flow to an advance port and direct hydraulic flow to a retract port, the ports for hydraulic connection to the hydraulic tool, in use;

fluid conduit means connecting the pump and reservoir to the directional valve;

a flow switch for detecting return flow from the directional valve to the reservoir;

pressure sensing means for sensing hydraulic pressure from the pump;

a dump valve operatively connected to the pump for directing hydraulic flow back to the reservoir when the directional valve is in the neutral position; and a programmable logic control means operatively connected to said motor, said directional valve, said flow switch and said pressure sensing means for controlling operation of the auto cycle pump in an automatic mode of operation in accordance with a stored program, the automatic mode of operation including energizing the motor and controlling a repeatable cycle, the cycle including a) operating the directional valve to either the advance position or the retract to selectively advance or retract the tool, b) returning the directional valve to the neutral position when the flow switch senses loss of return flow, c) completing the cycle when the flow switch again senses loss of flow after flow from decompression of the fluid conduit means has stopped, wherein step a) being configured to operate the valve alternately to the advance position and the retract position in alternate cycles, the repeatable cycle continuing until a select pressure is sensed by the pressure sensing means.

10. The auto cycle pump of claim 9 wherein said directional valve comprises a pilot operated directional valve.

11. The auto cycle pump of claim 9 wherein said pump comprises a two stage pump.

12. The auto cycle pump of claim 9 further comprising a user actuated control connected to said control means for initiating operation of the automatic mode of operation.

13. The auto cycle pump of claim 9 wherein said programmable control device stores a cycle time representing duration of each cycle the cycle time being used in a subsequent cycle to anticipate cycle time.

14. The auto cycle pump of claim 13 wherein a portion of the cycle time is used to ignore the flow switch to prevent premature cycle completion.

15. The auto cycle pump of claim 9 wherein said programmable control device stores a cycle time representing duration of each advance cycle and each retract cycle the cycle time being used in each subsequent respective advance cycle or retract cycle to anticipate cycle time.

* * * * *